US007819258B2

(12) United States Patent
Bae

(10) Patent No.: US 7,819,258 B2
(45) Date of Patent: Oct. 26, 2010

(54) FUEL FILTER ASSEMBLY

(75) Inventor: Yeonnoh Bae, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 72 days.

(21) Appl. No.: 12/336,151

(22) Filed: Dec. 16, 2008

(65) Prior Publication Data

US 2009/0289005 A1 Nov. 26, 2009

(30) Foreign Application Priority Data

May 23, 2008 (KR) ..... 10-2008-0048206

(51) Int. Cl.
*F02M 37/22* (2006.01)

(52) U.S. Cl. ..... 210/416.4; 210/436; 210/437; 210/446

(58) Field of Classification Search ..... 210/416.4, 210/436, 437, 438, 440, 446
See application file for complete search history.

(56) References Cited

U.S. PATENT DOCUMENTS 1,366,760 A * 1/1921 Zimmerman ..... 210/94
3,239,064 A * 3/1966 White ..... 210/436
3,262,433 A * 7/1966 Jordan ..... 123/73 A
3,871,843 A * 3/1975 Leftwich ..... 96/365
4,512,884 A * 4/1985 Wheatley ..... 210/136
5,192,430 A * 3/1993 Mohr ..... 210/172.1
5,489,384 A * 2/1996 Janik et al. ..... 210/436
6,787,033 B2 * 9/2004 Beard et al. ..... 210/323.2

FOREIGN PATENT DOCUMENTS

| | | |
|---|---|---|
| JP | 7194909 | 8/1995 |
| JP | 11002161 | 1/1999 |
| JP | 2006046142 | 2/2006 |
| KR | 1020060034347 | 4/2006 |
| KR | 10-0791818 B1 | 1/2008 |

* cited by examiner

*Primary Examiner*—Fred Prince
(74) *Attorney, Agent, or Firm*—Morgan, Lewis & Bockius LLP

(57) ABSTRACT

A fuel filter assembly includes a housing connected between a fuel tank and a high-pressure pump supplying fuel to a common rail injecting the fuel pumped from the fuel tank to an engine through a pipeline; a filter incorporated in the housing to filter impurities in the fuel pumped from the fuel tank; and a center pipe disposed in an inner space of the housing in a longitudinal direction of the housing and substantially enclosed by the filter, wherein bottom portion of the center pipe is spaced from bottom portion of the housing, the center pipe discharging filtered fuel collected in the bottom portion of the center pipe by suction of the high-pressure pump.

16 Claims, 2 Drawing Sheets

FUEL FILTER ASSEMBLY

CROSS-REFERENCE TO RELATED APPLICATION

The present application claims priority to Korean Application Number 10-2008-0048206 filed May 23, 2008, the entire contents of which application is incorporated herein for all purposes by this reference.

BACKGROUND OF THE INVENTION

1. Field of the Invention

The present invention relates a fuel filter, and more particularly, to a fuel filter assembly having an internal air-through passage.

2. Description of Related Art

Generally, in fuel supply in a diesel engine, an injection pump is implemented by injecting fuel in a fuel tank to a combustion chamber of the engine through an injection pump after generating boost pressure with a high-pressure pump for introducing the fuel in the fuel tank through a fuel filter filtering impurities. The fuel filter filters the impurities in the fuel and removes moisture included in the fuel.

In a diesel vehicle, as the setting pressure of the high-pressure pump is in range of approximately 300 bar to 1,600 bar, an ECU (Engine Control Unit) senses an error if the actual pressure of a common rail distributing fuel injection is lower than target pressure by 170 bar to 200 bar or more for one second and controls a fuel amount so that engine RPM is not 2,800 rpm or more in order to protect the high-pressure pump.

As a result, in order to prevent a fault of the fuel filter which is one of causes bringing about such problem, that is, a case that the fuel filter is mounted in the vehicle in a state that air remains in the fuel filter filtering the impurities in the fuel pumped in the fuel tank through the high-pressure pump, an air venting operation of the fuel filter is essentially required in a vehicle assembly line.

However, in case that an inlet of the fuel filter is not filled with the fuel, the air cannot help remaining in the fuel filter and even though the air venting operation is completely carried out, the air is generated in the fuel filter in the course of radical acceleration of fluid in a fault of the fuel itself or lack of a fuel residual quantity in the fuel tank. These phenomena cause pressure drop of the common rail due to the air included in the fuel supplied to the engine, thereby bringing about an acceleration error upon driving.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a fuel filter to prevent an acceleration error of a vehicle even when the air remains in a fuel filter due to incompletion of the air venting operation of the fuel filter.

A fuel filter assembly according to an aspect of the present invention may include a housing connected between a fuel tank and a high-pressure pump pumping fuel from the fuel tank and supplying filtered fuel to a common rail injecting the filtered fuel to an engine, a filter incorporated in inner circumference of the housing to filter impurities of the fuel pumped from the fuel tank, and/or a center pipe disposed in inner space of the filter in a longitudinal direction of the filter and substantially enclosed by the filter, wherein lower portion of the center pipe is spaced from inner bottom portion of the housing with a predetermined distance, the center pipe discharging the filtered fuel collected in the lower portion of the center pipe by the high-pressure pump.

The housing may include an inlet port positioned on outer lower portion of the housing and connected to the fuel tank to supply the fuel from the fuel tank to outer circumference of the filter.

Outer upper portion of the housing may include an inlet port to supply the fuel from the fuel tank to outer circumference of the filter.

The center pipe may include a hollow pipe body disposed over the inner bottom portion of the housing with the predetermined distance, and/or an upper body extending upwards from the hollow pipe body, the upper body tapered outwards with a predetermined angle with respect to longitudinal axis of the hollow pipe body, wherein outlet of the upper body is coupled to a pipeline connected to the high-pressure pump.

The support frame may include a frame body displaced on the inner bottom portion of the housing, wherein a portion of the frame body supports the lower portion of the center pipe upwards, ribs formed on the frame body and enclosing the center pipe by a predetermined interval to secure rigidity and form the opened passages to allow the fuel to pass therethrough and to be collected at the lower portion of the center pipe, and/or a gap forming end disposed upper end of the support frame to allow an air discharge end portion between the center pipe and the support frame to collect air therebetween and to have an inclined section to correspond to the upper body of the center pipe. The passages may be formed in a radial direction between the filter and the center pipe.

A small bypass hole may be formed between the upper body of the center pipe and the gap forming end of the support frame so as to allow the air trapped in upper portion of the support frame to flow out of the upper body of the center pipe through the small bypass hole. The bypass hole may have approximately a diameter of 0.5 mm or less. A plurality of the bypass hole may be formed.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
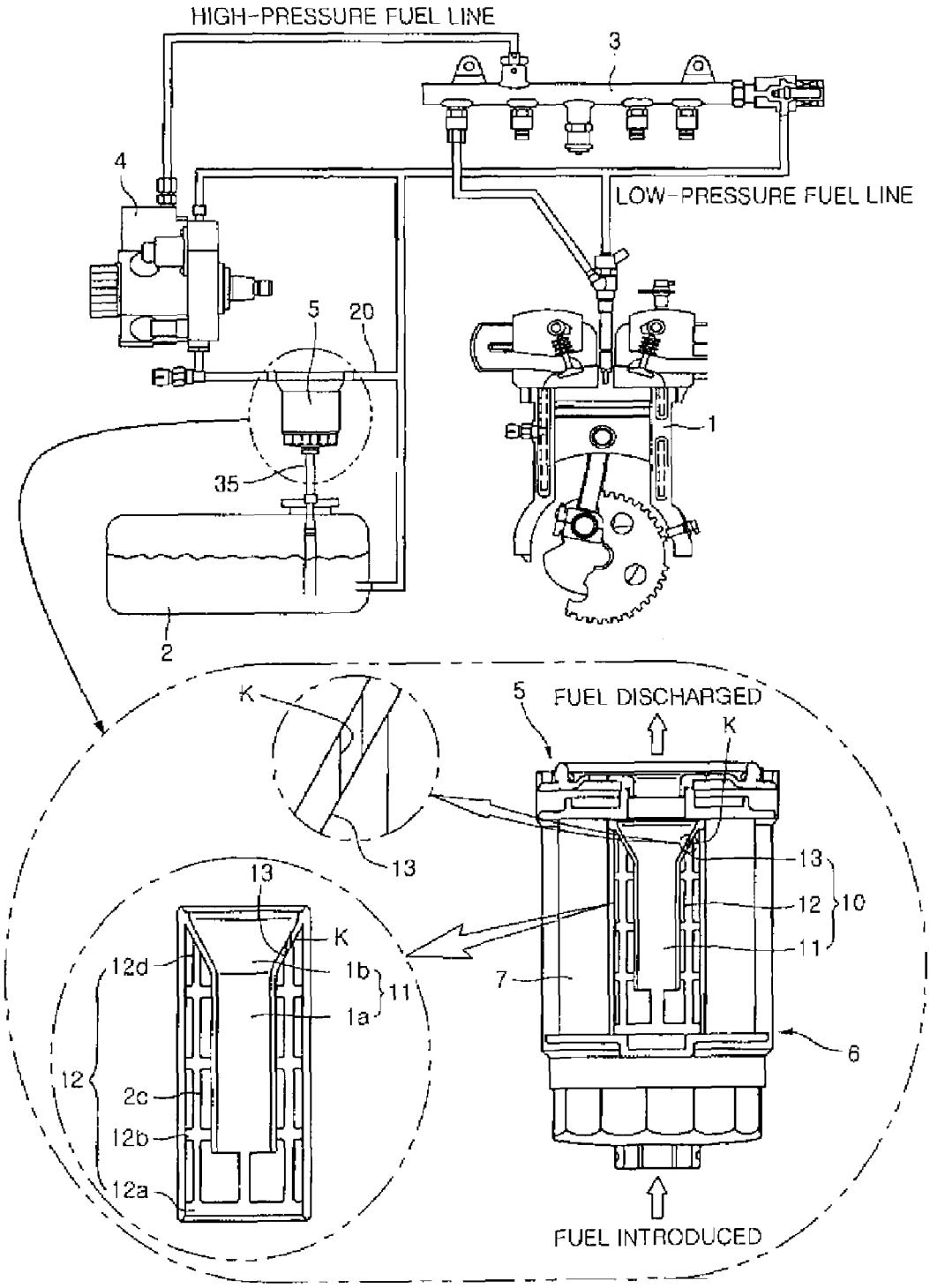
FIG. 1 is a block diagram of a fuel supply system of a vehicle with an exemplary fuel filter assembly having an internal air-through passage according to the present invention.

Referring to FIG. 1, a high-pressure pump 4 pumping fuel in a fuel tank 2 is provided to inject the fuel to a diesel engine 1 through a common rail 3. A fuel filter assembly 5 with a filter 7 is provided for filtering impurities in the fuel pumped from fuel tank 2 between high-pressure pump 4 and fuel tank 2.

Fuel filter assembly 5 is operated to allow only a very small quantity of air to be discharged with the fuel while air remains in an upper space of fuel filter 7 during the fuel is discharged upward the fuel filter assembly 5 after the fuel introduced into outer surface of the fuel filter 7 passes through filter 7 and then is collected in an inner bottom portion of fuel filter assembly 5.

The fuel may be supplied to the fuel filter 7 through an input passage 35 connecting the bottom portion of the fuel filter assembly 5 and the fuel tank 2 and/or an input passage 20 connecting the upper portion of the fuel filter assembly 5 and the fuel tank 2.

Fuel filter assembly 5 comprises a housing 6 forming the entire outer surface and is installed in a pipeline allowing high-pressure pump 4 and fuel tank 2 to be in communication with each other.

The fuel filter assembly 5 includes filter 7 filtering the impurities in the introduced fuel and a fuel discharge passage 10 which is disposed in an inner space of filter 7 in a longitudinal direction of housing 6 and serves to discharge the filtered fuel collected in a bottom portion of housing 6 upwards, wherein the bottom portion of fuel discharge passage 10 and the bottom portion of housing 6 have a space therebetween to receive the filtered fuel.

An upper end of fuel discharge passage 10 is connected to a pipeline 30 which connected to high-pressure pump 4.

The fuel discharge passage 10 includes a hollow center pipe 11 having a lower end portion spaced from the inner bottom portion of housing 6, a support frame 12 disposed between the filter 7 and the hollow center pipe 11 and having a lower end supported on the bottom of housing 6, wherein the support frame 12 surrounds the center pipe 11 and includes a plurality of opened spaces formed by ribs 12*b* to allow the fuel passing through filter 7 to be collected into the bottom portion of the center pipe 11, and an air discharge end portion 13 with a small bypass hole K having a minute diameter, wherein the air discharge end portion 13 collects air separated from the fuel in the upper portion of the support frame 12.

Center pipe 11 includes a hollow pipe body 11*a* and an upper body 11*b* which extends from the upper body 11*b* upwards and is tapered such that a diameter of an outlet thereof is increased and is connected to the pipeline 30 which is connected to high-pressure pump 4 in series.

Support frame 12 comprises a passage 12*c* which is a space formed by a frame of a predetermined thickness and is opened to allow the fuel to pass therethrough. Support frame 12 further includes a frame body 12*a* coupled to lower portion of center pipe 11 to support the center pipe 11, and ribs 12*b* integrally formed with frame body 12*a* and surrounding the center pipe 11 by a predetermined interval to secure rigidity of the center pipe 11 and the passage 12*c*.

A gap forming end 12*d* is formed in an upper portion of support frame 12. Gap forming end 12*d* allows the air discharge end portion 13 to be formed between the lower surface of the tapered upper body 11*b* and the support frame 12. Accordingly, the gap forming end 12*d* has an inclined section to correspond to tapered upper body 11*b* of center pipe 11 and thus the air discharge end portion 13 is formed therebetween.

A plurality of the bypass holes K are configured to communicate between air discharge end portion 13 and upper surface of the tapered upper body 11*b* to communicate therebetween. The diameter of bypass hole K is approximately 0.5 mm. The minute diameter of bypass hole K allows the air collected under the tapered upper body 11*b* to go through the bypass hole K in a very small quantity.

Since the air discharge end portion 13 with minute bypass hole K for reducing an air passing amount is formed at the gas forming end 12*d* in an upper portion of support frame 12, the very small quantity of the air 5 may be supplied with the filtered fuel when the fuel that is introduced into and passes through filter 7 flows through the filter 7 with separation of air from the fuel and downwards along the support frame 12, and is again discharged upwards along the hollow center pipe 11. Accordingly, the air discharged with the fuel may be restricted to the very small quantity even though the air remaining in the upper portion of the support frame 12 is much, thereby preventing an acceleration error and a damage of high-pressure pump 4.

For this, fuel filter assembly 5 includes fuel discharge passage 10 formed in the inner space of filter 7 received in housing 6 and filtering the impurities in the introduced fuel. Fuel discharge passage 10 includes hollow center pipe 11 having tapered upper body 11*b* connected to the pipeline 30 which is connected to high-pressure pump 4 as shown in FIG. 1, and support frame 12 with passage 12*c* serving as a space for introducing the fuel into center pipe 11, wherein the support frame 12 is coupled to center pipe 11 while surrounding center pipe 11.

When the fuel introduced into fuel filter 7 goes down, air discharge end portion 13 formed with small bypass hole K of the minute diameter at upper portion of the support frame 12 is provided in fuel discharge passage 10 in order to separate air from the fuel and prevent a lump of the air collected in the upper portion of fuel filter 7 from passing through fuel discharge passage 10 at once with a large amount.

As described above, since fuel discharge passage 10 allowing the fuel to be discharged from the inside of fuel filter 7 to the high-pressure pump 4 allows the fuel to be discharged and disables the air in fuel filter 7 to be introduced into high-pressure pump 4 in a very large quantity, fuel discharge passage 10 also prevents the acceleration error due to pressure drop of common rail 3 injecting the fuel to engine 1 and the damage of high-pressure pump 4.

Figure 2:
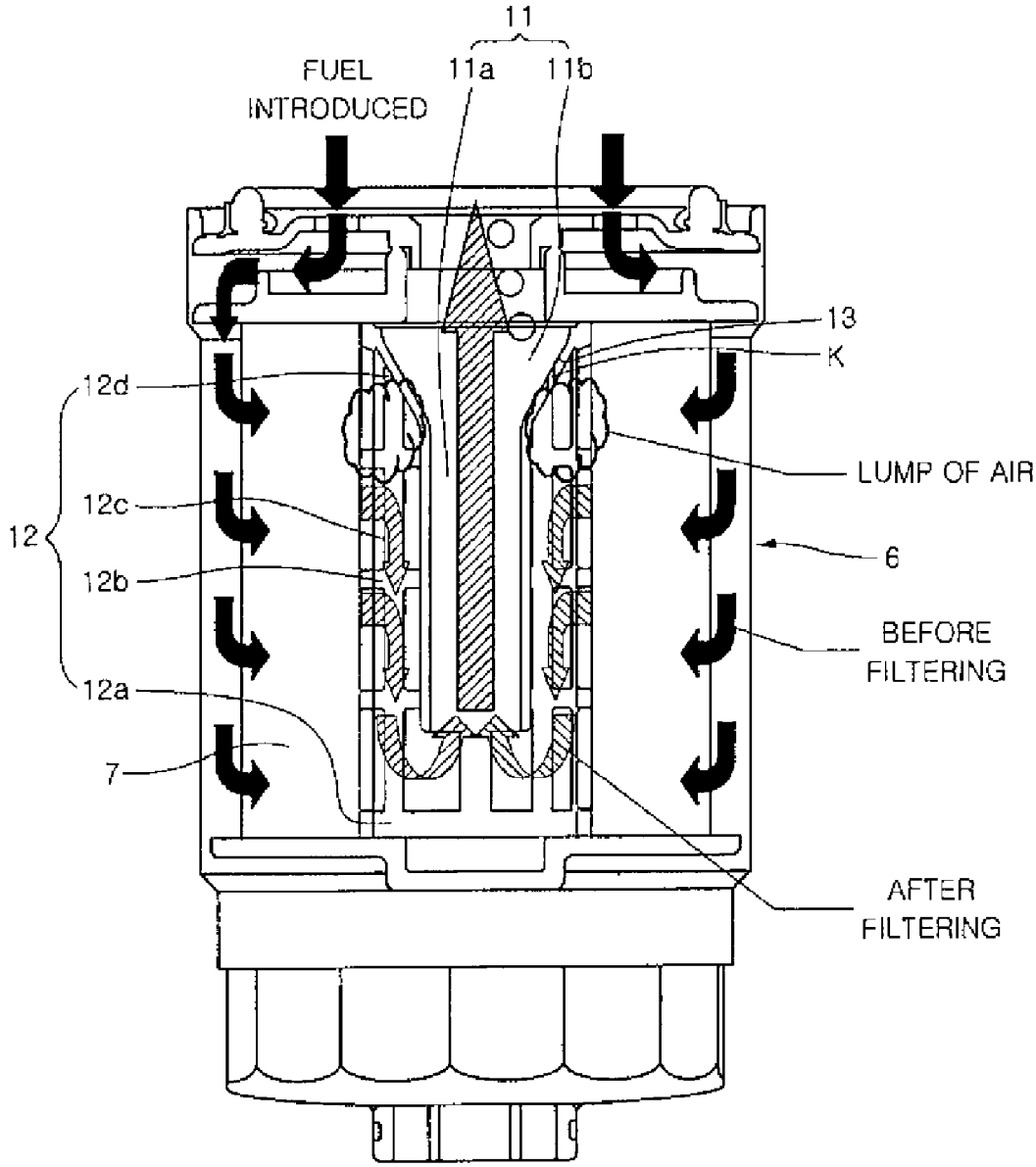
FIG. 2 is an operational diagram of an exemplary fuel filter assembly according to the present invention.

As shown in FIG. 2, in the operation of fuel filter assembly 5, when the fuel in fuel tank 2 is introduced into fuel filter 7 by suction force of high-pressure pump 4, the impurities in the fuel is filtered by filter 7 and the filtered fuel is introduced into fuel discharge passage 10 positioned in the inner space of filter 7.

The fuel introduced into fuel discharge passage 10 goes down while being introduced through passage 12*c* of support frame 12 supporting hollow center pipe 11. After the going-down fuel is collected into bottom portion of center pipe 11 receiving suction force of high-pressure pump 4, the fuel is introduced into high-pressure pump 4 through the pipeline 30 connected to center pipe 11.

During such fuel discharging, the air separated from the fuel is collected at the upper portion of support frame 12, and thus the lump of the air collected in the upper portion of fuel filter 7 is trapped in the upper portion of fuel discharge passage 10.

Some of the air collected in the upper portion of the fuel filter 7 may go down with the fuel toward the bottom portion of the center pipe 11. However, due to small bypass hole K formed at upper portion of the support frame 12, the influence of the air flowing down with the fuel toward the bottom portion of the center pipe 11 may be not be large. Furthermore, to reduce the influence of the air flowing down with the fuel toward the bottom portion of the center pipe 11. One may increase the number of bypass hole K.

At this time, although the flow of the fuel may be retarded by air discharge end portion 13 plugging the gap formed between gap forming end 12*d* and upper body 11*b*, the fuel is discharged through the bottom portion of the hollow center pipe 11. In contrast, the air trapped in the upper portion of the support frame 12 flows through the bypass hole K in a very small quantity, wherein the bypass holes K is configured to communicate between an upper surface of the tapered upper body 11*b* and a space formed between the air discharge end portion 13 and lower surface of the tapered upper body 11*b*.

The operation of bypass holes K restricts the discharged fuel amount to a very minute amount. Accordingly, only the very small quantity of discharged air passes through bypass holes K and discharged with the fuel.

As a result, a large amount of air introduced into high-pressure pump 4 through fuel discharge passage 10 is not introduced at once even when the air remains in fuel filter 7. Accordingly, in case that the actual pressure of common rail 3 is lower than target pressure by 170 bar to 200 bar for one second, an ECU restricts the fuel amount to prevent the acceleration error in a driver's unconscious state in order to protect high-pressure pump 4.

According to various aspects of the present invention, there is an advantage in that as a minute bypass hole for reducing an air passing amount is formed between an upper portion of the center pipe and an upper portion of the support frame, a very small quantity of air remaining in the fuel filter may be supplied with the fuel when the fuel introduced into the fuel filter and passes through a filter flows from an upside to a downside, and is again discharged to the upside, whereby, the air discharged with the fuel may be restricted to the very small quantity, thereby preventing an acceleration error and a damage of a high-pressure pump.

For convenience in explanation and accurate definition in the appended claims, the terms "upper" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A fuel filter assembly comprising:

a housing connected between a fuel tank and a pump pumping fuel from the fuel tank and supplying filtered fuel to a common rail injecting the filtered fuel to an engine;

a filter incorporated in inner circumference of the housing to filter impurities of the fuel pumped from the fuel tank; and a center pipe disposed in inner space of the filter in a longitudinal direction of the filter and substantially enclosed by the filter, wherein lower portion of the center pipe is spaced from inner bottom portion of the housing with a predetermined distance, the center pipe discharging the filtered fuel collected in the lower portion of the center pipe by the pump, wherein the center pipe includes:

a hollow pipe body disposed over the inner bottom portion of the housing with the predetermined distance; and an upper body extending upwards from the hollow pipe body, the upper body tapered outwards with a predetermined angle with respect to longitudinal axis of the hollow pipe body, wherein outlet of the upper body is coupled to a pipeline connected to the pump, and wherein the support frame comprises:

a frame body displaced on the inner bottom portion of the housing, wherein a portion of the frame body supports the lower portion of the center pipe upwards;

ribs formed on the frame body and enclosing the center pipe by a predetermined interval to secure rigidity and form the opened passages to allow the fuel to pass therethrough and to be collected at the lower portion of the center pipe; and a gap forming end disposed at upper end of the support frame to allow an air discharge end portion between the upper body of the center pipe and the gap forming end of the support frame to collect air therebetween and to have an inclined section to correspond to the upper body of the center pipe.

2. The fuel filter assembly as defined in claim 1, wherein the housing includes an inlet port positioned on outer lower portion of the housing and connected to the fuel tank to supply the fuel from the fuel tank to outer circumference of the filter.

3. The fuel filter assembly as defined in claim 1, wherein outer upper portion of the housing includes an inlet port to supply the fuel from the fuel tank to outer circumference of the filter.

4. The fuel filter assembly as defined in claim 1, wherein the passages are formed in a radial direction between the filter and the center pipe.

5. The fuel filter assembly as defined in claim 1, wherein a small bypass hole is formed between the upper body of the center pipe and the gap forming end of the support frame so as to allow the air trapped in upper portion of the support frame to flow out of the upper body of the center pipe through the small bypass hole.

6. The fuel filter assembly as defined in claim 5, wherein the bypass hole has approximately a diameter of 0.5 mm or less.

7. The fuel filter assembly as defined in claim 5, wherein a plurality of the bypass hole is formed.

8. The fuel filter assembly as defined in claim 7 wherein the bypass hole has approximately a diameter of 0.5 mm or less.

9. A fuel filter assembly comprising:

a housing connected between a fuel tank and a pump pumping fuel from the fuel tank and supplying filtered fuel to a common rail injecting the filtered fuel to an engine;

a filter incorporated in inner circumference of the housing to filter impurities of the fuel pumped from the fuel tank;

a center pipe disposed in inner space of the filter in a longitudinal direction of the filter and substantially enclosed by the filter, wherein lower portion of the center pipe is spaced from inner bottom portion of the housing with a predetermined distance, the center pipe discharging the filtered fuel collected in the lower portion of the center pipe by the pump; and a support frame disposed between the center pipe and the filter and surrounding the center pipe to receive the center pipe therein and form a gap with the center pipe, wherein the support frame is supported on the inner bottom portion of the housing, the support frame including a plurality of opened passages to allow the fuel passing through the filter to be collected at the lower portion of the center pipe;

wherein the support frame comprises:

a frame body displaced on the inner bottom portion of the housing, wherein a portion of the frame body supports the lower portion of the center pipe upwards;

ribs formed on the frame body and enclosing the center pipe by a predetermined interval to secure rigidity and form the opened passages to allow the fuel to pass therethrough and to be collected at the lower portion of the center pipe; and a gap forming end disposed at upper end of the support frame to allow an air discharge end portion between upper portion of the center pipe and upper portion of the support frame to collect air therebetween and to have an inclined section to correspond to upper portion of the center pipe.

10. The fuel filter assembly as defined in claim 9, wherein the passages are formed in a radial direction between the filter and the center pipe.

11. The fuel filter assembly as defined in claim 10, wherein the bypass hole has approximately a diameter of 0.5 mm or less.

12. The fuel filter assembly as defined in claim 9, wherein a small bypass hole is formed between the upper portion of the center pipe and the upper portion of the support frame so as to allow air trapped in the upper portion of the support frame flow out of the upper portion of the center pipe through the small bypass hole.

13. The fuel filter assembly as defined in claim 9, wherein the bypass hole has approximately a diameter of 0.5 mm or less.

14. The fuel filter assembly as defined in claim 9, wherein a plurality of the bypass hole is formed.

15. The fuel filter assembly as defined in claim 9, wherein the housing includes an inlet port positioned on outer lower portion of the housing and connected to the fuel tank to supply the fuel from the fuel tank to outer circumference of the filter.

16. The fuel filter assembly as defined in claim 9, wherein outer upper portion of the housing includes an inlet port to supply the fuel from the fuel tank to outer circumference of the filter.

* * * * *